US006183164B1

(12) United States Patent
Canella

(10) Patent No.: US 6,183,164 B1
(45) Date of Patent: Feb. 6, 2001

(54) HYDROSTATIC BALANCING JACKET

(75) Inventor: Gabriele Canella, Rapallo (IT)

(73) Assignee: HTM Sport S.p.A. (IT)

( * ) Notice: Under 35 U.S.C. 154(b), the term of this patent shall be extended for 0 days.

(21) Appl. No.: 09/357,376

(22) Filed: Jul. 20, 1999

(30) Foreign Application Priority Data

Jul. 22, 1998 (IT) ..... GE98A0062

(51) Int. Cl.[7] ..... B63C 9/28; B63C 9/125
(52) U.S. Cl. ..... 405/186; 441/117; 441/129
(58) Field of Search ..... 405/186; 441/111, 441/115, 117, 119, 129; 224/934

(56) References Cited

U.S. PATENT DOCUMENTS

| | | | | |
|---|---|---|---|---|
| 2,864,101 | * | 12/1958 | Kissenberger | 224/934 X |
| 5,441,367 | * | 8/1995 | Toth | 405/186 |
| 5,516,233 | | 5/1996 | Courtney . | |
| 5,607,258 | | 3/1997 | Eungard . | |
| 5,626,439 | * | 5/1997 | Rowlands | 405/186 |
| 5,641,247 | * | 6/1997 | Seligman | 405/186 |
| 5,662,433 | * | 9/1997 | Seligman | 405/186 |
| 5,803,667 | * | 9/1998 | Seligman | 405/186 |
| 5,860,769 | * | 9/1999 | Seligman | 405/186 |

FOREIGN PATENT DOCUMENTS

| | | |
|---|---|---|
| 88 01 870 | 9/1988 | (DE) . |
| 0 360 636 | 3/1990 | (EP) . |

* cited by examiner

*Primary Examiner*—Eileen D. Lillis
*Assistant Examiner*—Tara L. Mayo
(74) *Attorney, Agent, or Firm*—Larson & Taylor, PLC

(57) ABSTRACT

A hydrostatic balancing jacket includes a dorsal element ending into two shoulder strips and two pectoral-abdominal strips. The dorsal element is equipped, on its outer side, with two wing-shaped strips. The wing-shaped strips are connected to the dorsal element along one of their rims. The wing-shaped strips are symmetrically located with respect to the longitudinal axis of the element and are inflatable.

6 Claims, 3 Drawing Sheets

HYDROSTATIC BALANCING JACKET

BACKGROUND OF THE INVENTION

The present invention relates to hydrostatic balancing jackets for scuba diving.

Traditional balancing jackets consist of a dorsal element ending into two abdominal-pectoral strips and two shoulder strips, which can be linked the ones to the others. Normally, the pectoral-abdominal strips can be inflated, thus allowing the scuba diver to float.

However, there are some drawbacks related to devices of this kind; in particular, the inflation of the two pectoral-abdominal strips, though allowing a good control of the user's trim, creates an evident pressure onto the user's abdomen.

Such problem has been overcome by designing and carrying out balancing jackets whose pectoral-abdominal strips cannot be inflated and whose air chambers are positioned on the dorsal element; such jackets are commonly known as "back-mounted" jackets. In this case, despite the elimination of the inconveniences arising from the arrangement described above, the floating is not so effective as it was before.

SUMMARY OF THE INVENTION

The present invention aims at providing a balancing jacket which, on the one hand, prevents pressure problems for the user, and, on the other, allows an optimal floating under any condition.

The object of the present invention is therefore a hydrostatic balancing jacket, consisting of a dorsal element ending into two shoulder strips and two pectoral-abdominal strips, characterised in that said dorsal element is equipped with two wing-shaped strips on its outer side, said strips being linked to said dorsal element along one of their rims and being symmetrical with respect to the longitudinal axis of the dorsal element, said wing-shaped strips being inflatable.

In one form of embodiment said wing-shaped strips are connected with the inflatable chambers which are located in the pectoral-abdominal strips.

Such wing-shaped strips advantageously form one only lap which is linked to the outer side of the dorsal element, in correspondence with its longitudinal axis.

In one form of embodiment the dorsal element is equipped with a back to which one or more bottles can be connected; the wing-shaped strips are located on the longer sides of the back.

BRIEF DESCRIPTION OF THE DRAWINGS

Further advantages and features related to the present invention will be more evident thanks to the following detailed description of a form of embodiment of such invention, which will be carried out as a non-limiting example, with reference to the enclosed drawings, where.

DESCRIPTION OF THE PREFERRED EMBODIMENT OF THE INVENTION

Figure 1:
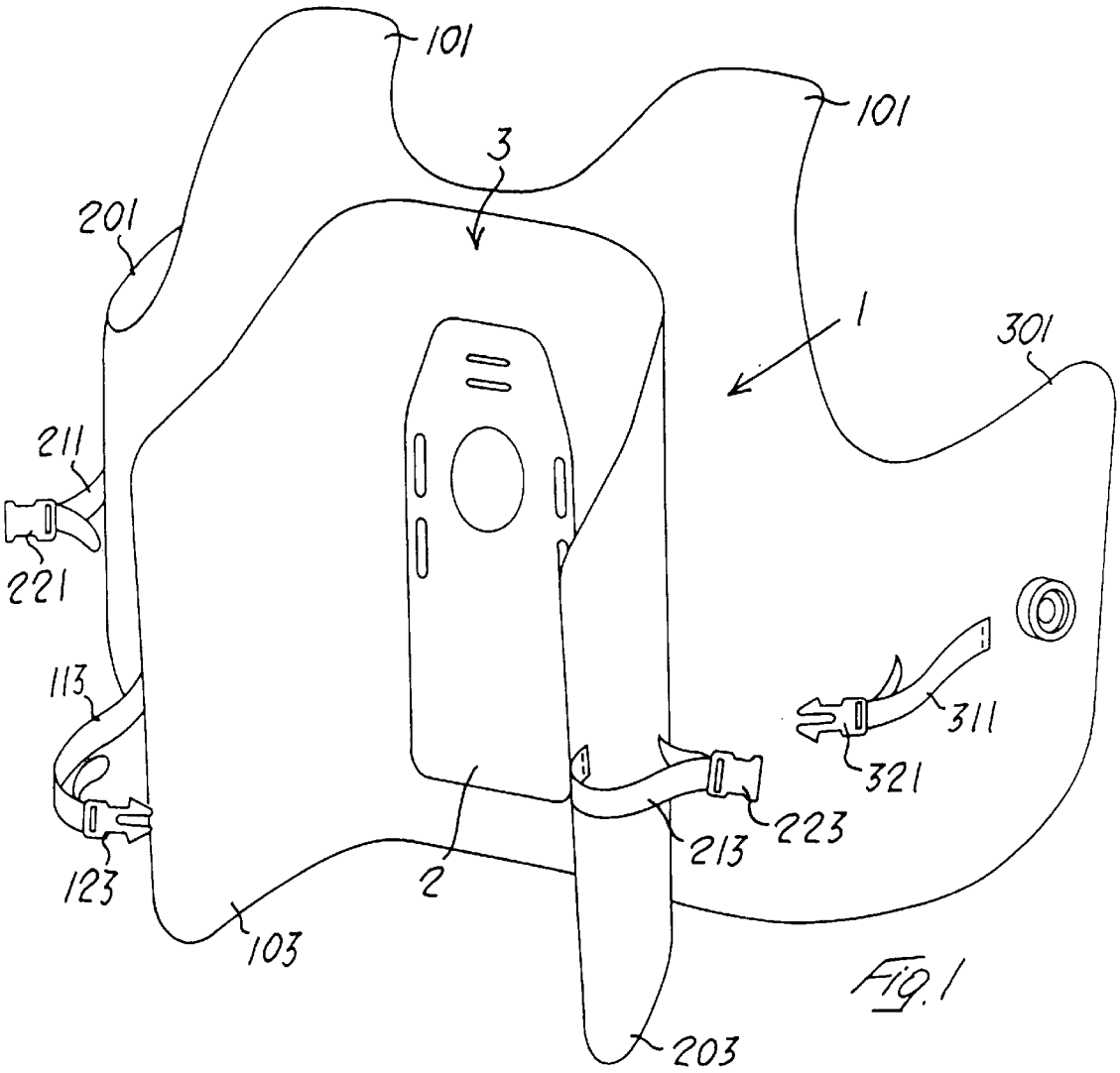
FIG. 1 is a perspective view of the balancing jacket according to the present invention.

FIG. 1 shows a balancing jacket according to the present invention; the numeral 1 indicates the dorsal element of the jacket. Such dorsal element 1 ends into two shoulder strips 101 and two pectoral-abdominal strips 201 and 301. A back 2, allowing the connection of one or more bottles (not shown in the figure), is applied onto the dorsal element 1, in correspondence with its longitudinal axis. Between the back 2 and the dorsal element 1 is located a lap 3 ending, on the two sides of the back 2, into two wing-shaped strips 103 and 203. Both the pectoral-abdominal strips 201 and 301 and the wing-shaped strips 103 and 203 are provided with belts, 211, 311 and 113 and 213, equipped on their ends with buckles, 221, 321 and 123 and 223.

Figure 2:
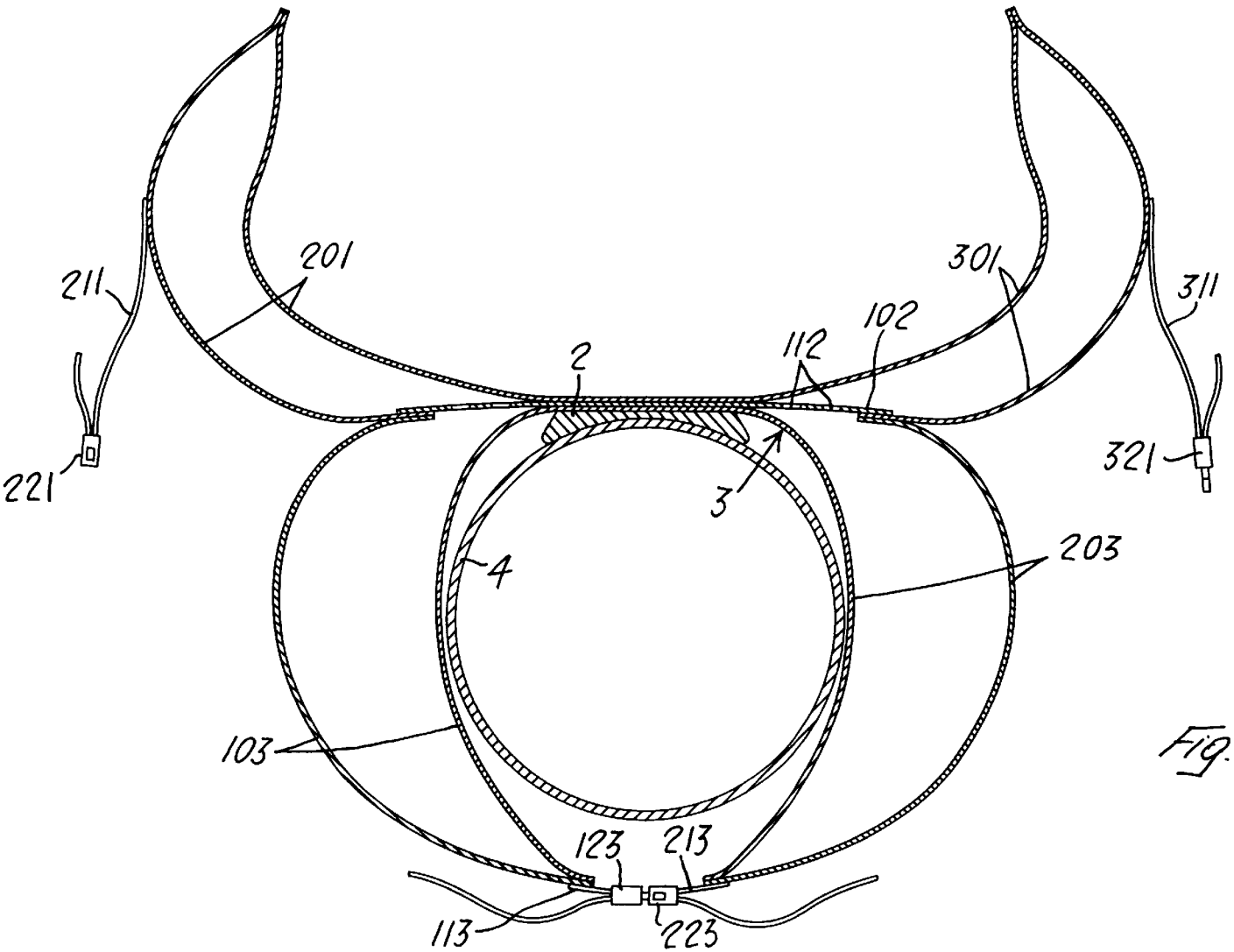
FIG. 2 is a cross section view of the jacket in FIG. 1, in a particular use condition.
Figure 3:
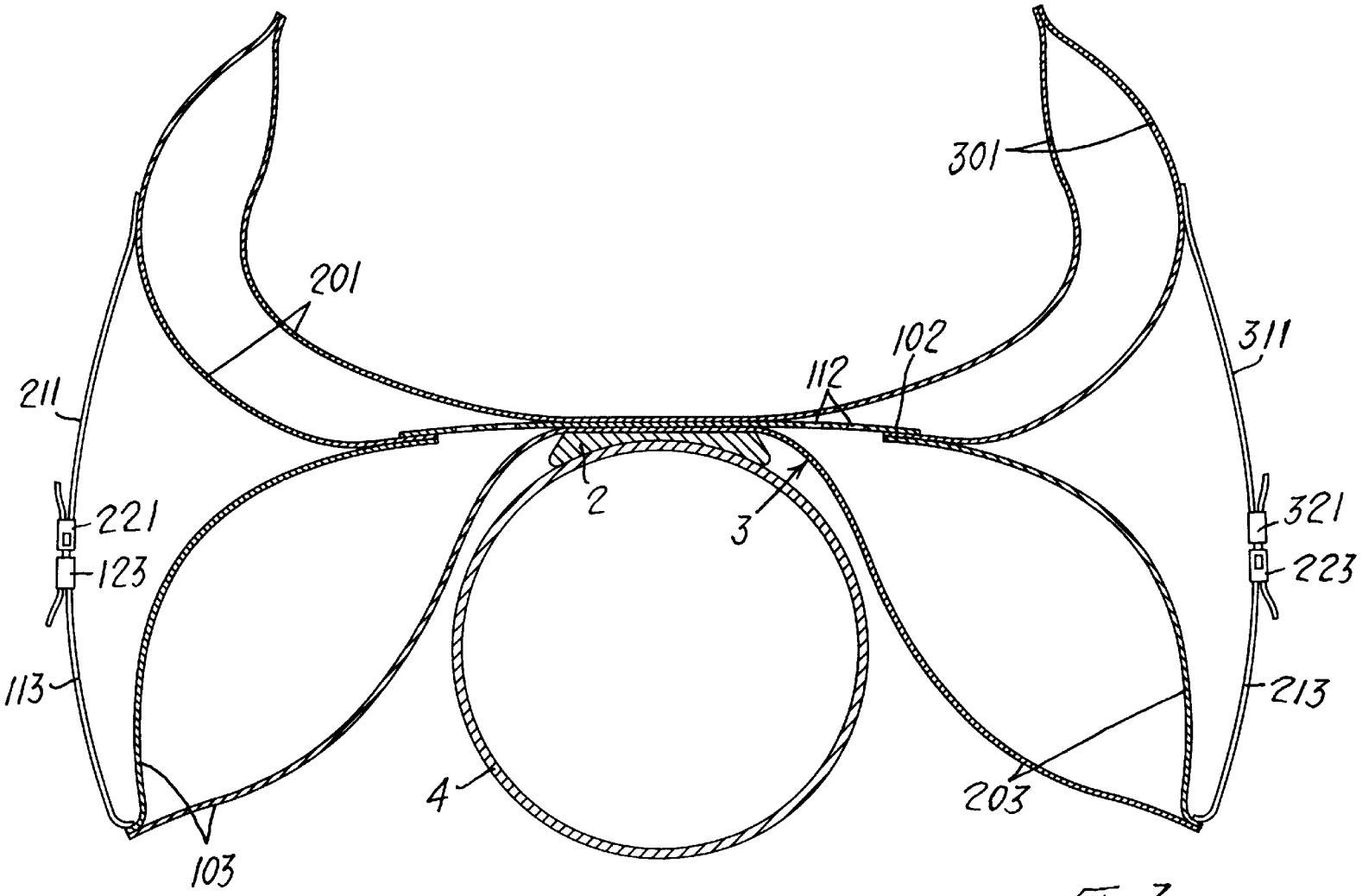
FIG. 3 is a cross section view of the jacket in FIG. 1, in another use condition.

FIG. 2 shows a possible use of the jacket according to the present invention. In the figure both the pectoral-abdominal strips 201, 301 and the wing-shaped strips 103, 203 are inflated. The chamber formed in the pectoral-abdominal strip 301 is connected to the chamber formed in the wing-shaped strip 203 by means of the holes 112 in the diaphragm 102, which is located between the lap 3 on one side and the dorsal element 1 on the other. A similar connection between the chamber of the pectoral-abdominal strip 201 and the chamber of the wing-shaped strip 103 has been symmetrically carried out. In this case, the two wing-shaped strips 103, 203 are connected one to the other by means of the coupling of the buckles 123 and 223 fixed onto their relative belts 113 and 213. The bottle 4 is thus surrounded by said wing-shaped strips 103, 203. FIG. 3 shows the jacket in a different form of embodiment; the same numerals indicate the same parts. Differently from FIG. 3, here the wing-shaped strips 103 and 203 are respectively connected to the pectoral-abdominal strips 201, 301, by means of the coupling of the buckles 221, 123 and 223, 321 fixed onto their relative belts 211, 113 and 213, 311.

Figure 4:
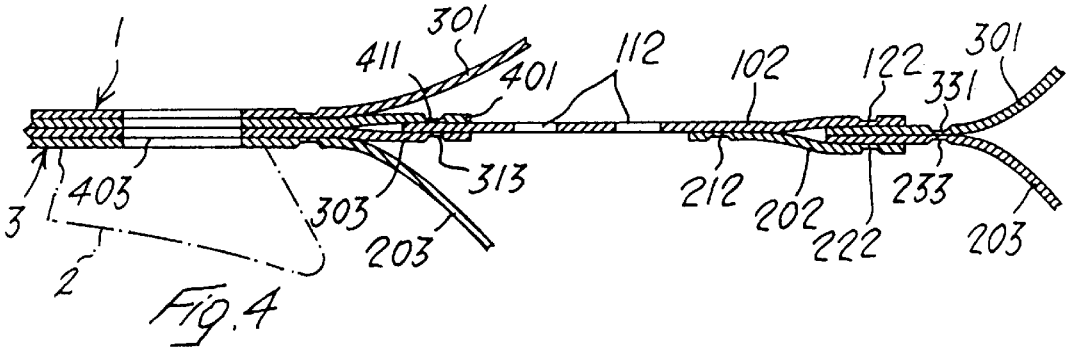
FIG. 4 is a enlarged view showing detail of the wing-shaped strips in FIG. 1.

Finally, FIG. 4 shows a detail in section concerning the connection between the chamber formed inside the pectoral-abdominal strip 301 and the chamber formed inside the wing-shaped strip 203. The diaphragm 102 is inserted between the walls 401 of the dorsal element 1 and 303 of the lap 3, and it is connected to such walls by means of the weld beads 411 and 313; the hole 403 passes through the dorsal element 2 and the lap 3, thus allowing the connection to the back 2. On the opposite end the same diaphragm 102 is equipped with a doubling strip 202 which is welded to it at 212 and which allows the fixing of the diaphragm to the walls 203 and 301. Said walls, which are welded together thanks to the welding lines 233 and 331, are inserted into the pocket formed by the diaphragm 102 and by the doubling strip 202, and they are connected to said pocket by means of the welding lines 122 and 222. As was said before, the air flows between the two chambers formed in the pectoral-abdominal strip 301 and in the wing-shaped strip 203 through the holes 112 pierced into the diaphragm.

Hereinafter the working of the device according to the present invention will be more evident. As was previously said, the idea lying behind the balancing jacket according to the present invention originates from the necessity to join a better hydrostatics with a greater practicality of use for the user. For such purpose, two wing-shaped strips 103, 203 have been located onto the dorsal element 1, symmetrical with respect to its longitudinal axis. As is evident from the FIGS. 2 and 3 of the enclosed drawings, the presence of said strips allows a visible increase in the jacket volume without any additional pressure onto the scuba diver's abdomen. At the same time, the jacket is balanced in the direction of the hydrostatic thrust, thus eliminating the inconveniences caused by "backmounted"-type jackets, as they are known at the present state of technology.

The wing-shaped strips, equipped with suitable connecting devices, i.e. the buckles 223 and 123, fixed onto their relative belts 213 and 113, can be let free, and they can also be linked to the correspondent pectoral-abdominal strips, which means that the wing-shaped strip 203 will be connected to the strip 301 and the wing-shaped strip 103 to the strip 201 (see FIG. 3). Moreover, the bottle 4 can be wrapped up with said wing-shaped strips 103, 203 as shown in FIG. 2. Such configuration is of particular advantage when the bottle 4 is particularly heavy and one needs to reduce the effect of such load onto the scuba diver.

The chambers formed in the wing-shaped strips 103, 203 and in the pectoral-abdominal strips 201, 301 can advantageously communicate as shown in the FIGS. 2 and 3. Between the dorsal element 1 of the jacket and the lap 3 a diaphragm 102 has been introduced, said diaphragm having a double object: on the one hand to allow, by means of several holes 112, the connection between said chambers, thus allowing the simultaneous inflation of all the parts of the jackets which can be inflated; on the other hand, the diaphragm, being firmly connected to the various elements of the jacket, makes the jacket more stiff, thus preventing possible deformations due to inflation which could adverse its practicality and hydrodynamics.

The balancing jacket thus conceived is therefore more practical for the user, providing, moreover, indubitable advantages as far as floating is concerned and representing a valid alternative for the dislocation of the bottle load.

What is claimed is:

1. A hydrostatic balancing jacket comprising a dorsal element ending into two shoulder strips and two pectoral-abdominal strips having formed therein inflatable chambers; and two wing-shaped strips connected to an outer side of said dorsal element along one of their rims and symmetrically located with respect to a longitudinal axis of said dorsal element, said wing-shaped strips having inflatable chambers.

2. The balancing jacket according to claim 1, wherein said wing-shaped strips are formed at ends of a lap connected to the outer side of the dorsal element in correspondence with the longitudinal axis of the dorsal element.

3. The balancing jacket according to claim 2, wherein said chambers within said wing-shaped strips are fluidly connected to the inflatable chambers formed in the pectoral-abdominal strips.

4. The balancing jacket according to claim 3 further comprising a diaphragm for fluidly connecting the chambers of said wing-shaped strips and the chambers of said abdominal-pectoral strips, the diaphragm being connected to the dorsal element and to said lap, and including several holes.

5. The balancing jacket according to claim 1 wherein said dorsal element includes a back for connection with one or more bottles, the wing-shaped strips being positioned along long sides of said back.

6. The balancing jacket according to claim 1, wherein said wing-shaped strips and said pectoral-abdominal strips include means for connection to each other.

* * * * *